US011840064B2

(12) United States Patent
Tsukuda et al.

(10) Patent No.: US 11,840,064 B2
(45) Date of Patent: Dec. 12, 2023

(54) RECORDING APPARATUS AND CONVEYING APPARATUS

(71) Applicant: CANON KABUSHIKI KAISHA, Tokyo (JP)

(72) Inventors: Masakazu Tsukuda, Kanagawa (JP); Akira Kida, Kanagawa (JP); Takaaki Ishida, Kanagawa (JP); Masaaki Matsuura, Kanagawa (JP); Koki Kudo, Kanagawa (JP); Atsushi Arai, Kanagawa (JP); Masashi Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 17/740,186

(22) Filed: May 9, 2022

(65) Prior Publication Data

US 2022/0388314 A1 Dec. 8, 2022

(30) Foreign Application Priority Data

Jun. 4, 2021 (JP) ..... 2021-093997

(51) Int. Cl.

| | |
|---|---|
| ***B41J 11/00*** | (2006.01) |
| ***B65H 5/38*** | (2006.01) |
| ***B65H 29/52*** | (2006.01) |
| ***B65H 85/00*** | (2006.01) |

(52) U.S. Cl.

CPC ..... *B41J 11/007* (2013.01); *B41J 11/005* (2013.01); *B41J 11/0045* (2013.01); *B65H 5/38* (2013.01); *B65H 29/52* (2013.01); *B65H 85/00* (2013.01); *B41J 11/0015* (2013.01); *B65H 2301/33312* (2013.01); *B65H 2301/5321* (2013.01); *B65H 2404/5214* (2013.01);

(Continued)

(58) Field of Classification Search

CPC ..... B41J 11/007; B41J 11/0045; B41J 11/005; B41J 11/0015; B65H 5/38; B65H 29/52; B65H 85/00; B65H 2301/33312; B65H 2301/5321; B65H 2404/5214; B65H 2404/561; B65H 2404/61; B65H 2801/15

See application file for complete search history.

(56) References Cited

U.S. PATENT DOCUMENTS

2005/0281598 A1* 12/2005 Hattori ..... G03G 21/1609 399/405
2011/0261130 A1* 10/2011 Hirai ..... B41J 11/007 347/101
2018/0326754 A1* 11/2018 Young ..... B65H 5/004

FOREIGN PATENT DOCUMENTS

JP 2000168979 A 6/2000

* cited by examiner

*Primary Examiner* — Henok D Legesse
(74) *Attorney, Agent, or Firm* — Canon U.S.A., Inc. I.P. Division

(57) ABSTRACT

A recording apparatus includes a conveying unit, a supporting unit, and a static elimination unit. The conveying unit conveys a recording medium in a first direction to a recording area where recording is performed by a recording unit. The supporting unit supports the recording medium conveyed by the conveying unit and includes an abutment surface that abuts the recording medium when the supporting unit supports the recording medium. The static elimination unit eliminates static from the recording medium in a static elimination portion. The static elimination portion is not provided at a position opposed to the abutment surface and is provided at a position not opposed to the abutment surface in the supporting unit.

20 Claims, 14 Drawing Sheets

(52) U.S. Cl.
CPC .... *B65H 2404/561* (2013.01); *B65H 2404/61* (2013.01); *B65H 2801/15* (2013.01)

13
12
S
7
7b
8
18
11
P
Pa
19
129
6C
6B
6A
71B
7a
C1
C2
x
y
z

RECORDING APPARATUS AND CONVEYING APPARATUS

BACKGROUND

Field

The present disclosure relates to a recording apparatus including a static elimination unit that eliminates static from a medium, and a conveying apparatus.

Description of the Related Art

A recording apparatus is known in which a static elimination unit is provided to eliminate static from a recording medium that is conveyed. For example, Japanese Patent Application Laid-Open No. 2000-168979 discusses a recording apparatus as illustrated in FIG. 14. The recording apparatus drives a sheet feeding unit abutting a recording medium, thereby supplying the recording medium to a conveying unit. Then, the conveying unit conveys the recording medium. A configuration is discussed in which a static elimination unit is provided at a position opposed to the conveying unit, and the static elimination unit and the recording medium elastically abut each other, thereby eliminating static from the recording medium.

In the configuration discussed in Japanese Patent Application Laid-Open No. 2000-168979, however, static is eliminated from the recording medium according to the combined amount of charge of the amounts of charge of both the recording medium and the conveying unit. As the conveying unit conveys the recording medium, the amount of charge of the conveying unit increases. Thus, if static corresponding to the total amount of charge of the recording medium and the conveying unit is eliminated, the phenomenon may occur that the amount of charge of the recording medium after passing through the static elimination unit conversely increases. This raises an issue that static is not efficiently eliminated.

SUMMARY

The present disclosure is directed to providing a recording apparatus that efficiently eliminates static from a recording medium.

According to an aspect of the present disclosure, a recording apparatus includes a conveying unit configured to convey a recording medium in a first direction to a recording area where recording is performed by a recording unit, a supporting unit configured to support the recording medium conveyed by the conveying unit, wherein the supporting unit includes an abutment surface configured to abut the recording medium when the supporting unit supports the recording medium, and a static elimination unit configured to eliminate static from the recording medium in a static elimination portion, wherein the static elimination portion is not provided at a position opposed to the abutment surface and is provided at a position not opposed to the abutment surface in the supporting unit.

Further features of the present disclosure will become apparent from the following description of exemplary embodiments with reference to the attached drawings.

DESCRIPTION OF THE EMBODIMENTS

Figure 1:
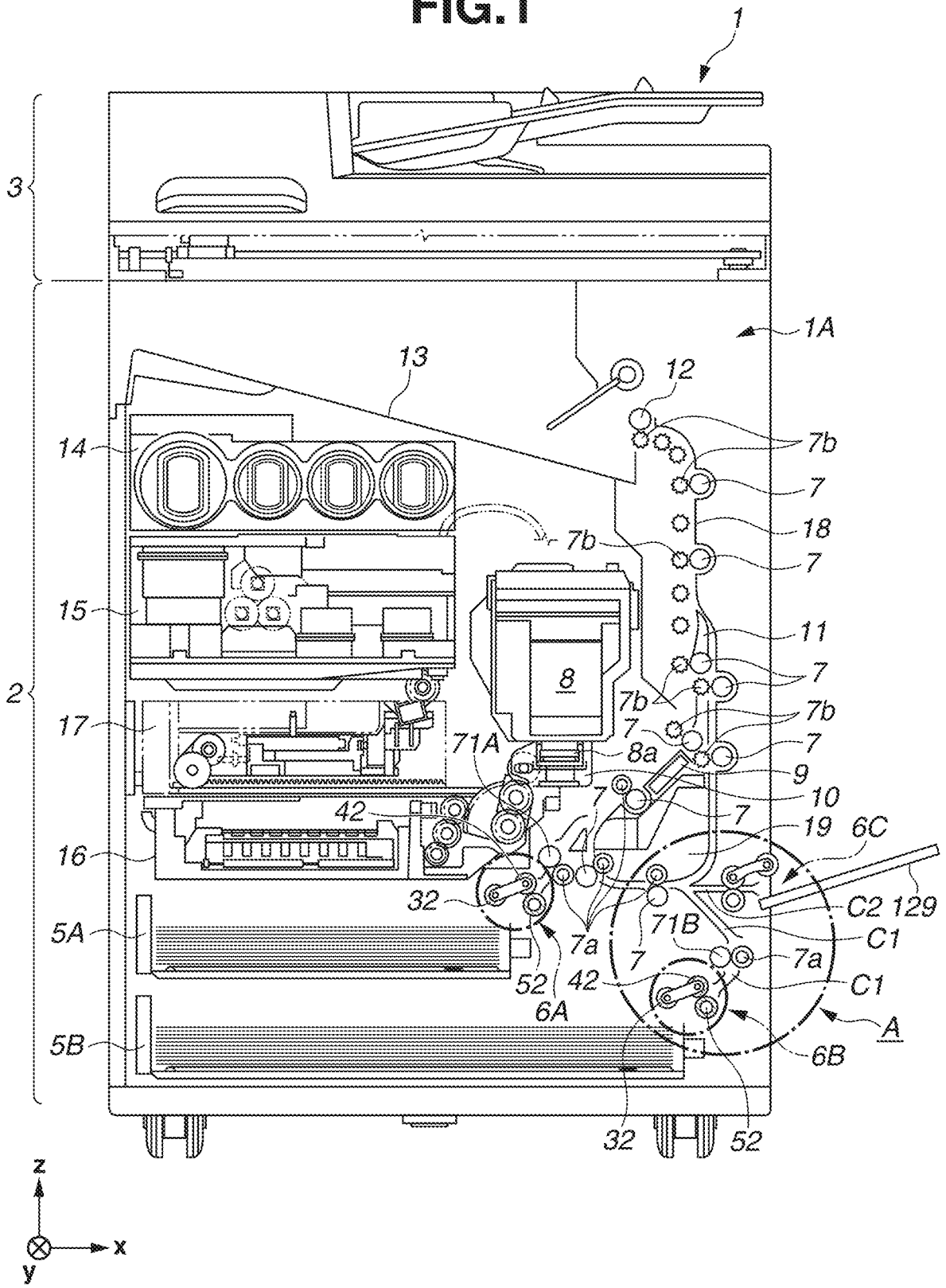
FIG. 1 is a front view of a recording apparatus in a standby state.

FIG. 1 is a diagram illustrating the internal configuration of an inkjet recording apparatus 1 (hereinafter, "recording apparatus 1") used in the exemplary embodiments. In FIG. 1, an x-direction represents the horizontal direction, a y-direction (a direction orthogonal to the plane of the paper) represents the direction in which discharge ports are arranged in a recording head 8 (a recording unit), and a z-direction represents the vertical direction.

In the specification, a "recording medium" refers to an object to which liquid is discharged, and is used as the collective term for media made of non-metal materials such as paper, cloth, plastic film, wood, and leather.

The recording apparatus 1 is a multifunction peripheral including a print unit 2 and a scanner unit 3. The print unit 2 and the scanner unit 3 can individually or cooperatively execute various processes regarding a recording operation and a reading operation. The scanner unit 3 includes an auto document feeder (ADF) and a flatbed scanner (FBS). The scanner unit 3 can read a document automatically fed by the ADF and read (scan) a document placed on a document platen of the FBS by a user. Although the multifunction peripheral includes both the print unit 2 and the scanner unit 3 in the exemplary embodiments, a form may be employed in which the multifunction peripheral does not include the scanner unit 3. FIG. 1 illustrates a state where the recording apparatus 1 is in a standby state where the recording apparatus 1 is performing neither the recording operation nor the reading operation.

In a housing of the print unit 2, a first cassette 5A and a second cassette 5B (a first supply source) in which a recording medium S (a cut sheet) can be stacked are detachably installed in a bottom portion of the housing, which is on the lower side in the vertical direction. In the first cassette 5A, relatively small recording media S up to the A4 size are stored in a stacked state. In the second cassette 5B, relatively large recording media S up to the A3 size are stored in a stacked state. Near each cassette, a cassette feeding unit (a first feeding portion) is provided that separates the recording media S stored in the cassette one by one and feeds each recording medium S. In the following description, the cassette feeding unit that feeds the recording medium S from the first cassette 5A is referred to as a "first feeding unit 6A", and the cassette feeding unit that feeds the recording medium S from the second cassette 5B is referred to as a "second feeding unit 6B".

In a side portion of the housing of the print unit 2, a manual feed tray 129 (a second supply source) is provided that is used by the user to supply a relatively small number of recording media S. In the manual feed tray 129, not only recording media S of a regular size as in the above cassettes but also recording media S of an irregular size can be placed. Recording media S are placed at a predetermined position in the manual feed tray 129, whereby a manual feeding unit 6C (a second feeding portion) operates, and each recording medium S can be fed to a conveying path. The print unit 2 selectively causes any one of the first feeding unit 6A, the second feeding unit 6B, and the manual feeding unit 6C as a feeding unit to operate. Consequently, recording media S are supplied one by one to a recording area P (a supply target portion) between a recording head 8 and a platen 9.

A conveying mechanism (a conveying unit) for conveying each recording medium S in a predetermined direction includes conveying rollers 7, a first intermediate roller 71A, a second intermediate roller 71B, a discharge roller 12, pinch rollers 7*a*, spurs 7*b*, a guide member 18, an inner guide 19, and a flapper 11. The conveying rollers 7 are driving rollers that are disposed upstream and downstream of the recording head 8 (the platen 9) and driven by conveying motors. The pinch rollers 7*a* are driven rollers that rotate while nipping the recording medium S with the conveying rollers 7. The discharge roller 12 is a driving roller that is disposed downstream of the conveying rollers 7 and driven by a discharge motor. The spurs 7*b* convey the recording medium S while nipping the recording medium S with the conveying rollers 7 and the discharge roller 12 disposed downstream of the recording head 8 (the platen 9).

In the recording apparatus 1, a plurality of motors for driving the driving rollers is provided, and each of the driving rollers is connected to one of the plurality of motors. The correspondence relationships between the motors and the driving rollers will be described in detail below.

The guide member 18 is provided in a conveying path of the recording medium S and guides the recording medium S in the predetermined direction. The inner guide 19 is a member extending in the y-direction and includes a curved side surface. The inner guide 19 guides the recording medium S along the side surface. The flapper 11 is a member for switching the direction in which the recording medium S is conveyed according to a one-sided recording operation for performing recording on one surface of the recording medium S or a two-sided recording operation. A discharge tray 13 is a tray for stacking and holding the recording medium S for which the recording operation is completed and which is discharged by the discharge roller 12.

The recording head 8 according to the exemplary embodiments is a full-line type color inkjet recording head. In the recording head 8, a plurality of discharge ports for discharging ink based on recording data is arranged corresponding to the maximum width of the applicable recording medium S along the y-direction in FIG. 1. When the recording head 8 is at a standby position, a discharge port surface 8*a* of the recording head 8 is directed vertically downward and capped by a cap unit 10 as illustrated in FIG. 1. When the recording operation is performed, the direction of the recording head 8 is changed by a print controller 202 so that the discharge port surface 8*a* is opposed to the platen 9. The platen 9 includes a flat plate extending in the y-direction and supports a surface (the back surface (a second surface)) on the opposite side of the front surface (a first surface) of the recording medium S on which the recording operation is performed by the recording head 8. The movement of the recording head 8 from the standby position to a recording position will be described in detail below.

An ink tank unit 14 stores ink of four colors to be supplied to the recording head 8. An ink supply unit 15 is provided in the middle of a flow path connecting the ink tank unit 14 and the recording head 8 and adjusts the pressure and the flow rate of ink in the recording head 8 to appropriate ranges. In the exemplary embodiments, a circulating ink supply system is employed, and the ink supply unit 15 adjusts the pressure of ink to be supplied to the recording head 8 and the flow rate of ink to be collected from the recording head 8 to appropriate ranges.

A maintenance unit 16 includes the cap unit 10 and a wiping unit 17. The maintenance unit 16 causes the cap unit 10 and the wiping unit 17 to operate at a predetermined timing, thereby performing a maintenance operation on the recording head 8. The maintenance operation will be described in detail below.

Figure 2:
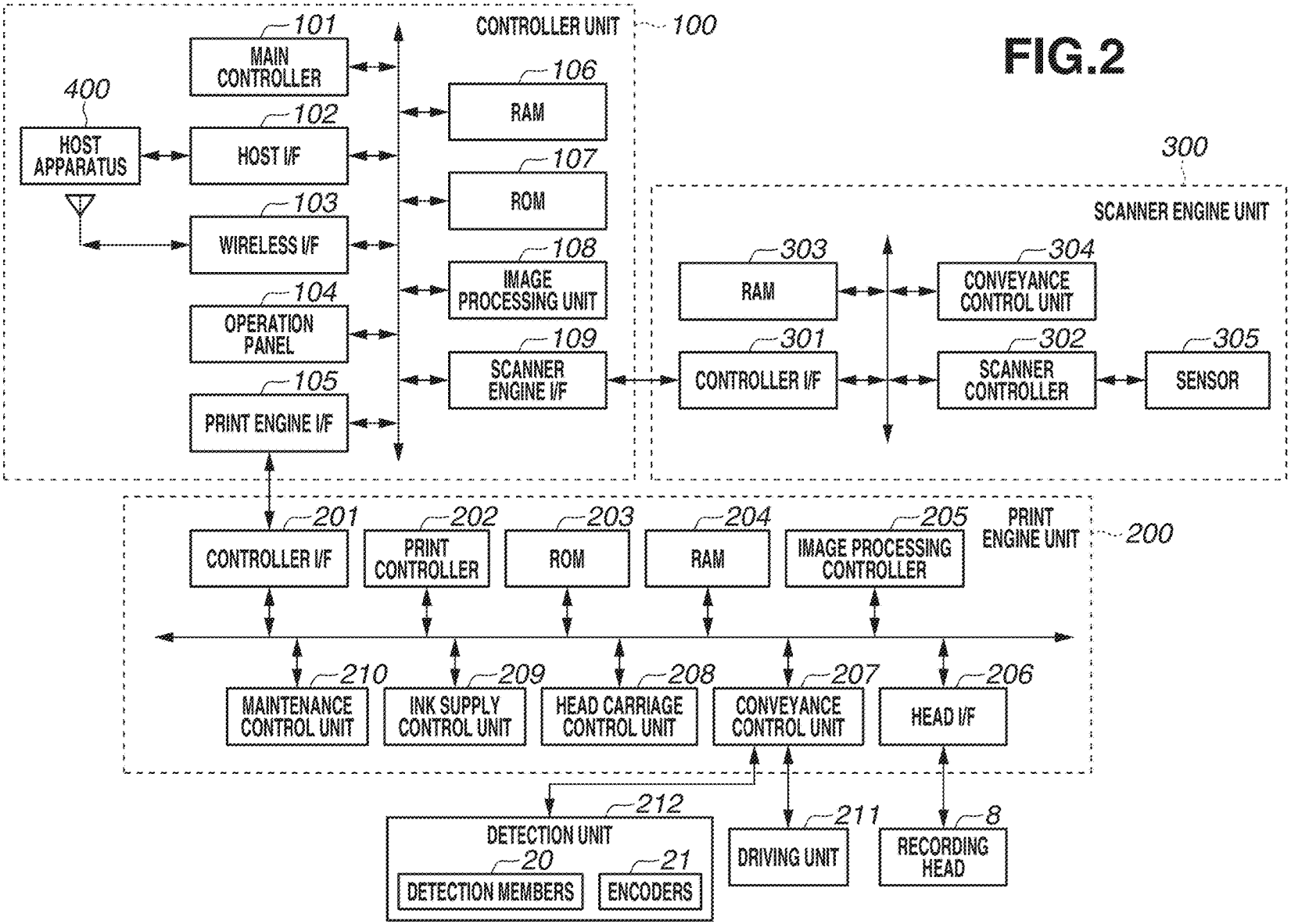
FIG. 2 is a diagram illustrating a control configuration of the recording apparatus.

FIG. 2 is a block diagram illustrating the control configuration of the recording apparatus 1. The control configuration includes a print engine unit 200 that mainly performs overall control of the print unit 2, a scanner engine unit 300 that performs overall control of the scanner unit 3, and a controller unit 100 (a control unit) that performs overall control of the entire recording apparatus 1. According to an instruction from a main controller 101 of the controller unit 100, a print controller 202 controls various mechanisms of the print engine unit 200. Various mechanisms of the scanner engine unit 300 are controlled by the main controller 101 of the controller unit 100. The details of the control configuration will be described below.

In the controller unit 100, the main controller 101 including a central processing unit (CPU) controls the entire recording apparatus 1 using a random-access memory (RAM) 106 as a work area according to a program and various parameters stored in a read-only memory (ROM) 107. For example, if a print job is input from a host apparatus 400 via a host interface (I/F) 102 or a wireless I/F 103, then according to an instruction from the main controller 101, an image processing unit 108 performs predetermined image processing on received image data. Then, the main controller 101 transmits the image data subjected to the image processing to the print engine unit 200 via a print engine I/F 105.

The recording apparatus 1 may acquire image data from the host apparatus 400 through wireless communication or wired communication, or may acquire image data from an external storage device (e.g., a Universal Serial Bus (USB) memory) connected to the recording apparatus 1. The communication method used in the wireless communication or the wired communication is not limited. For example, as the communication method used in the wireless communication, wireless fidelity (Wi-Fi®), a family of wireless network protocols, or Bluetooth®, a short-range wireless technology standard is applicable. As the communication method used in the wired communication, USB is applicable. For example, if a reading command is input from the host apparatus 400, the main controller 101 transmits the command to the scanner unit 3 via a scanner engine I/F 109.

An operation panel 104 is a portion for the user to provide an input to and an output from the recording apparatus 1. The user can give an instruction to perform a copy operation or a scan operation, set a print mode, or recognize information regarding the recording apparatus 1 through the operation panel 104.

In the print engine unit 200, the print controller 202 including a CPU controls various mechanisms of the print unit 2 using a RAM 204 as a work area according to a program and various parameters stored in a ROM 203. If various commands or image data is received via a controller I/F 201, the print controller 202 temporarily saves the various commands or the image data in the RAM 204. To enable the recording head 8 to execute the recording operation (an ink discharge operation), the print controller 202 causes an image processing controller 205 to convert the saved image data into recording data. If the recording data is generated, the print controller 202 causes the recording head 8 to execute the recording operation based on the recording data via a head I/F 206. At this time, the print controller 202 appropriately drives the first feeding unit 6A, the second feeding unit 6B, the manual feeding unit 6C, the conveying rollers 7, the discharge roller 12, and the flapper 11 illustrated in FIG. 1 via a conveyance control unit 207, thereby feeding and conveying the recording medium S.

The conveyance control unit 207 is connected to a detection unit 212 that detects the conveyance state of the recording medium S, and a driving unit 211 that drives the plurality of driving rollers. Based on detection results obtained from the detection unit 212, the conveyance control unit 207 controls the feeding and the conveyance of the recording medium S using the driving unit 211. The detection unit 212 includes detection members 20 that detect the presence or absence of the recording medium S, and encoders 21 that detect the amounts of rotation of the driving rollers.

In the process in which the conveyance control unit 207 conveys the recording medium S, the recording head 8 executes the recording operation according to an instruction from the print controller 202.

A head carriage control unit 208 changes the direction or the position of the recording head 8 according to an operation state such as a maintenance state or a recording state of the recording apparatus 1. An ink supply control unit 209 controls the ink supply unit 15 so that the pressure of ink to be supplied to the recording head 8 falls within an appropriate range. When the maintenance operation is performed on the recording head 8, a maintenance control unit 210 controls the operations of the cap unit 10 and the wiping unit 17 of the maintenance unit 16.

In the scanner engine unit 300, the main controller 101 controls the hardware resources of a scanner controller 302 using the RAM 106 as a work area based on a program and various parameters stored in the ROM 107.

This controls various mechanisms of the scanner unit 3. For example, the main controller 101 controls the hardware resources in the scanner controller 302 via a controller I/F 301, thereby conveying a document placed on the ADF by the user via a conveyance control unit 304 and causing a sensor 305 to read the document. Then, the scanner controller 302 saves image data of the read document in a RAM 303. The print controller 202 converts the image data acquired as described above into recording data thereby causing the recording head 8 to execute the recording operation based on the image data read by the scanner controller 302.

Figure 3:
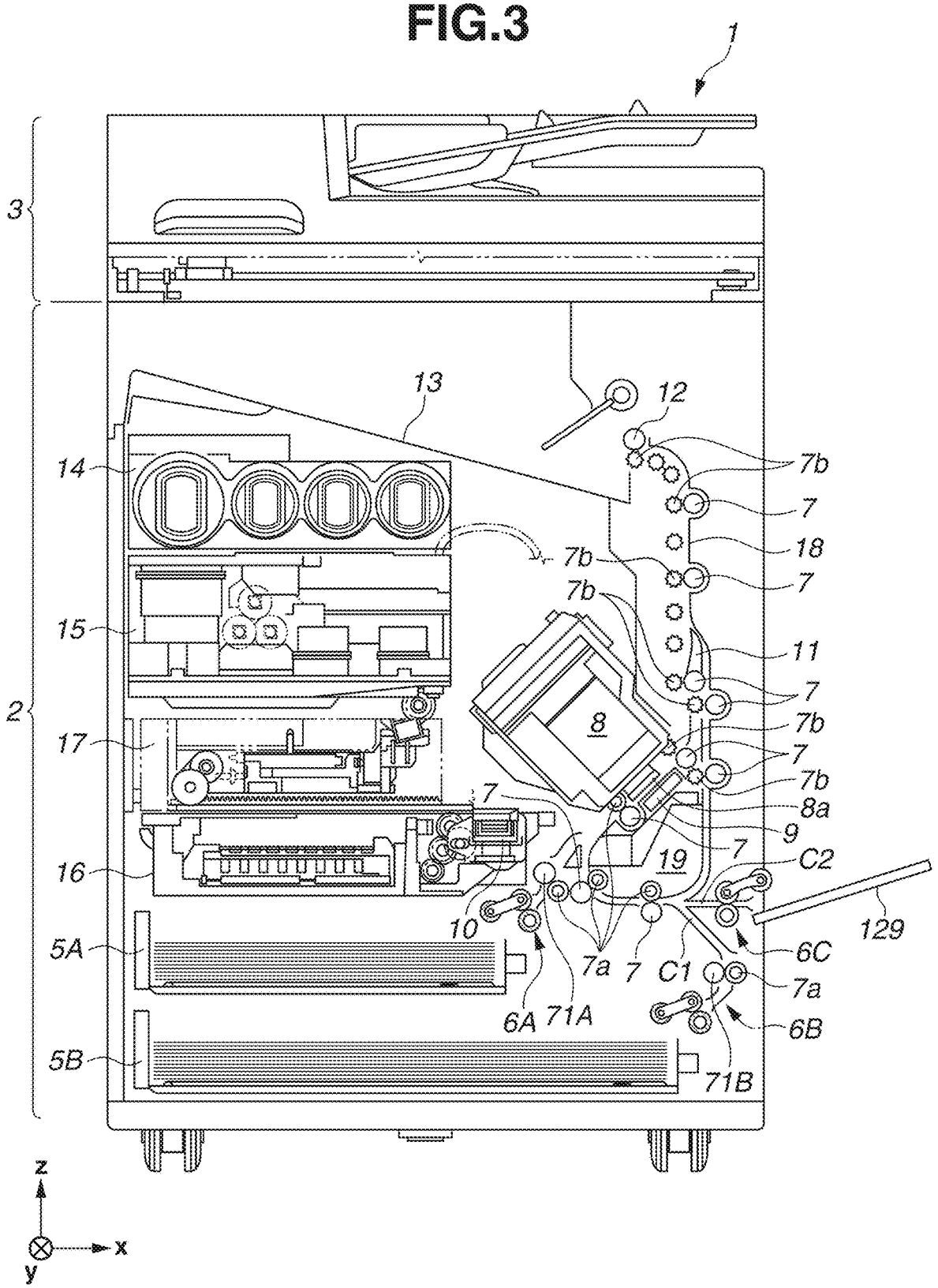
FIG. 3 is a diagram illustrating a recording state of the recording apparatus.

FIG. 3 illustrates the recording state of the recording apparatus 1. As compared to the standby state illustrated in FIG. 1, the cap unit 10 is separated from the discharge port surface 8*a* of the recording head 8, and the discharge port surface 8*a* is opposed to the platen 9. In the exemplary embodiments, a supporting surface of the platen 9 that supports the recording medium S is inclined at approximately 45 degrees with respect to the horizontal direction. The discharge port surface 8*a* of the recording head 8 at a recording position is also inclined at approximately 45 degrees with respect to the horizontal direction so that a constant distance is maintained between the discharge port surface 8*a* and the platen 9.

When moving the recording head 8 from the standby position illustrated in FIG. 1 to the recording position illustrated in FIG. 3, the print controller 202 causes the cap unit 10 to fall to a retracted position illustrated in FIG. 3 using the maintenance control unit 210. Consequently, the cap unit 10 separates from the discharge port surface 8*a* of the recording head 8. Then, the print controller 202 rotates the recording head 8 45 degrees while adjusting the height in the vertical direction of the recording head 8 using the head carriage control unit 208, whereby the discharge port surface 8*a* is opposed to the platen 9. The recording operation is performed in this state. When the recording operation is completed and the recording head 8 moves from the recording position to the standby position, the print controller 202 performs a process opposite to the above.

Next, conveying paths of the recording medium S in the print unit 2 will be described. If a recording command is input, the print controller 202 first moves the recording head 8 to the recording position illustrated in FIG. 3 using the maintenance control unit 210 and the head carriage control unit 208. Then, the print controller 202 drives any one of the first feeding unit 6A, the second feeding unit 6B, and the manual feeding unit 6C using the conveyance control unit 207 based on the recording command, thereby feeding the recording medium S.

Figure 4A:
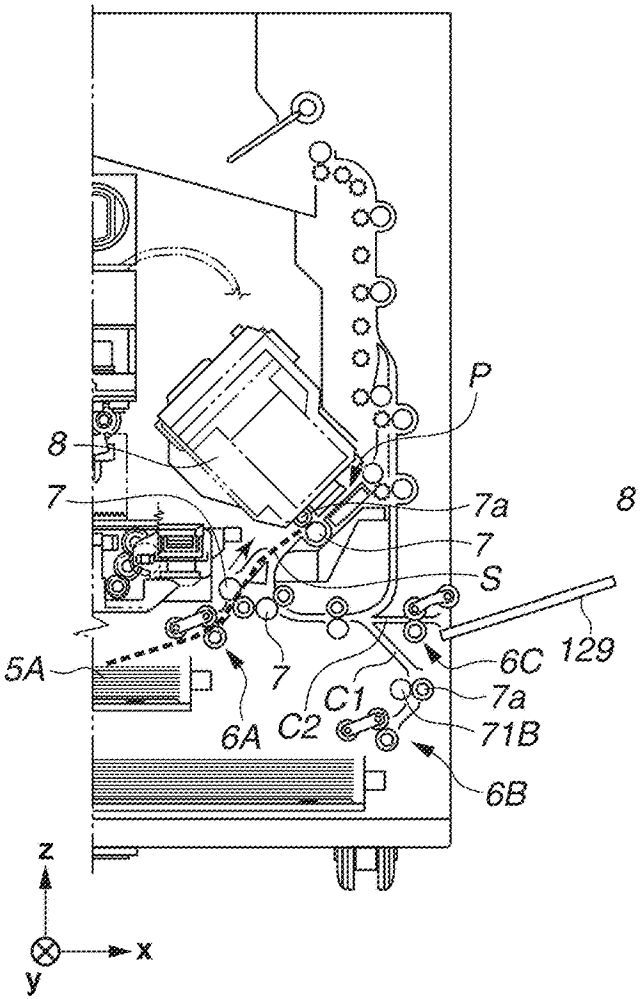
FIGS. 4A to 4C are diagrams illustrating a conveying path of a recording medium fed from a first cassette.
Figure 4B:
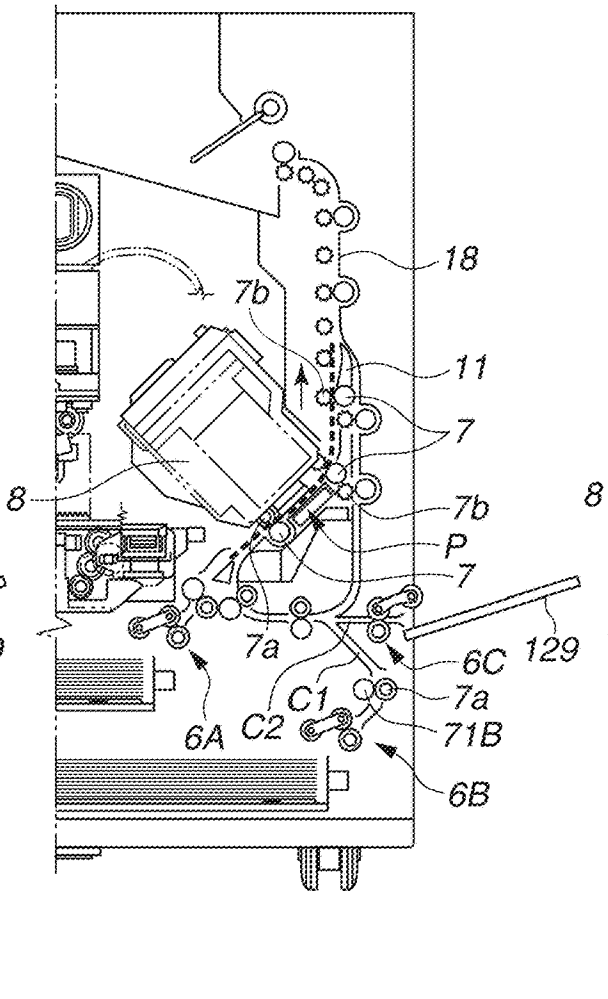
Figure 4C:
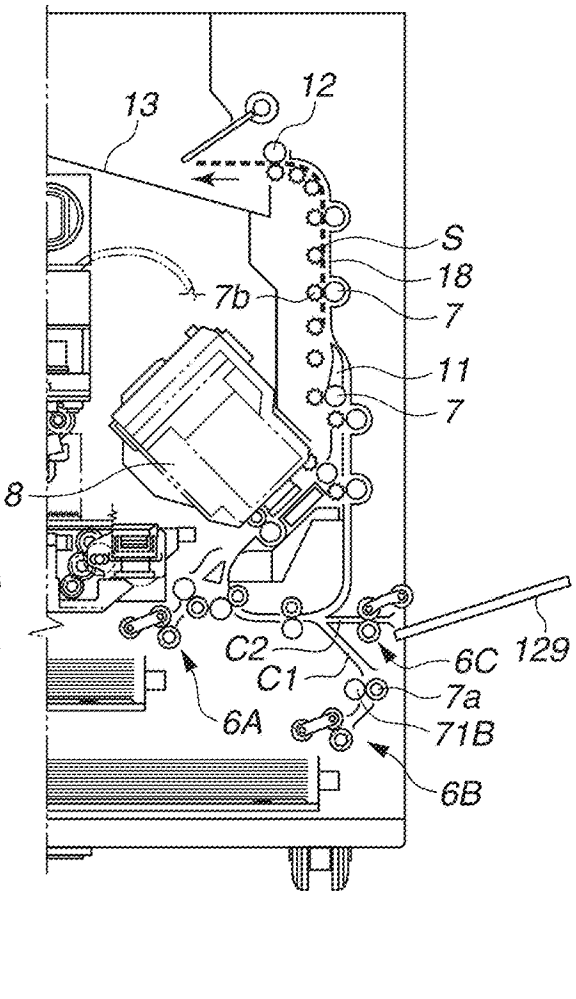

FIGS. 4A to 4C are diagrams illustrating a conveying path when recording media S of the A4 size stored in the first cassette 5A are fed. A recording medium S stacked on the top in the first cassette 5A is separated from the second and subsequent recording media S by the first feeding unit 6A. Then, the recording medium S is conveyed toward the recording area P (the supply target position) between the platen 9 and the recording head 8 while being nipped by conveying rollers 7 and pinch rollers 7*a*. FIG. 4A illustrates a conveyance state immediately before the leading edge of the recording medium S reaches the recording area P. While the recording medium S is fed by the first feeding unit 6A and reaches the recording area P, the moving direction of the recording medium S is changed from the horizontal direction (the x-direction) to a direction inclined approximately 45 degrees with respect to the horizontal direction.

In the recording area P, ink is discharged from the plurality of discharge ports provided in the recording head 8 toward the recording medium S. When the recording medium S reaches the recording area P, one surface (the back surface (the second surface)) of the recording medium S that is not opposed to the recording head 8 is supported by the platen 9, and a constant distance is maintained between the discharge port surface 8*a* and the recording medium S. After ink is applied to the recording medium S, the recording medium S passes through the left side of the flapper 11 the end of which is inclined to the right, while being guided by conveying rollers 7 and spurs 7*b*. Then, the recording medium S is conveyed vertically upward in the recording apparatus 1 along the guide member 18. FIG. 4B illustrates a state where the leading edge of the recording medium S passes through the recording area P and the recording medium S is conveyed vertically upward. The moving direction of the recording medium S is changed from the position in the recording area P inclined at approximately 45 degrees to the horizontal direction to a vertically upward direction by the conveying rollers 7 and the spurs 7*b*.

After the recording medium S is conveyed vertically upward, the recording medium S is discharged to the discharge tray 13 by the discharge roller 12 and spurs 7*b*. FIG. 4C illustrates a state where the leading edge of the recording medium S passes through the discharge roller 12 and the recording medium S is discharged to the discharge tray 13. The discharged recording medium S is held on the discharge tray 13 in a state where the surface of the recording medium S on which an image is recorded by the recording head 8 faces down.

Figure 5C:
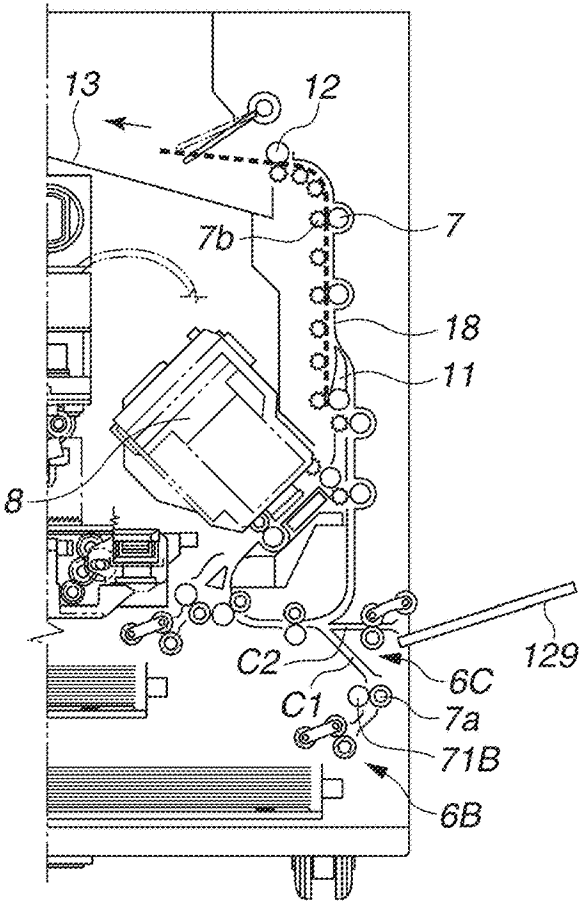
FIGS. 5A to 5C are diagrams illustrating a conveying path of the recording medium fed from a second cassette.
Figure 5B:
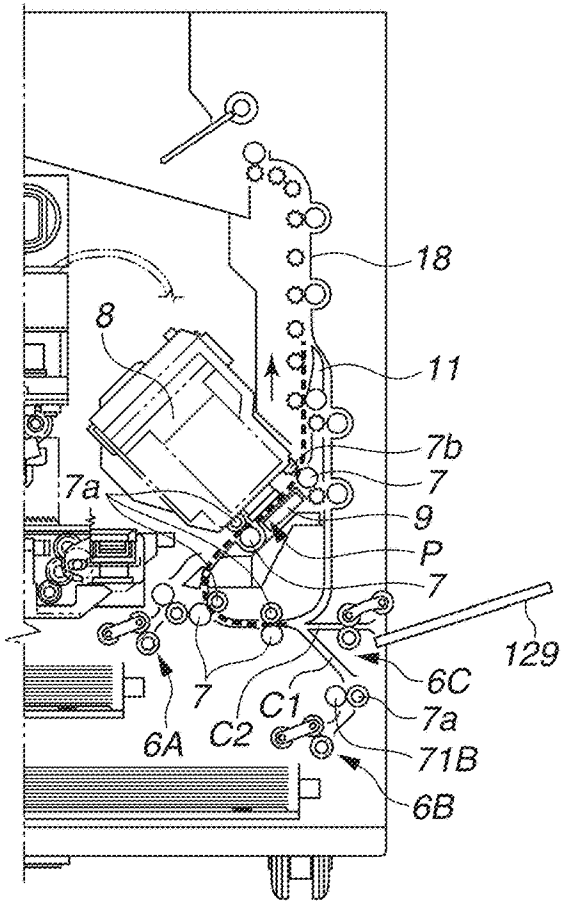
Figure 5A:
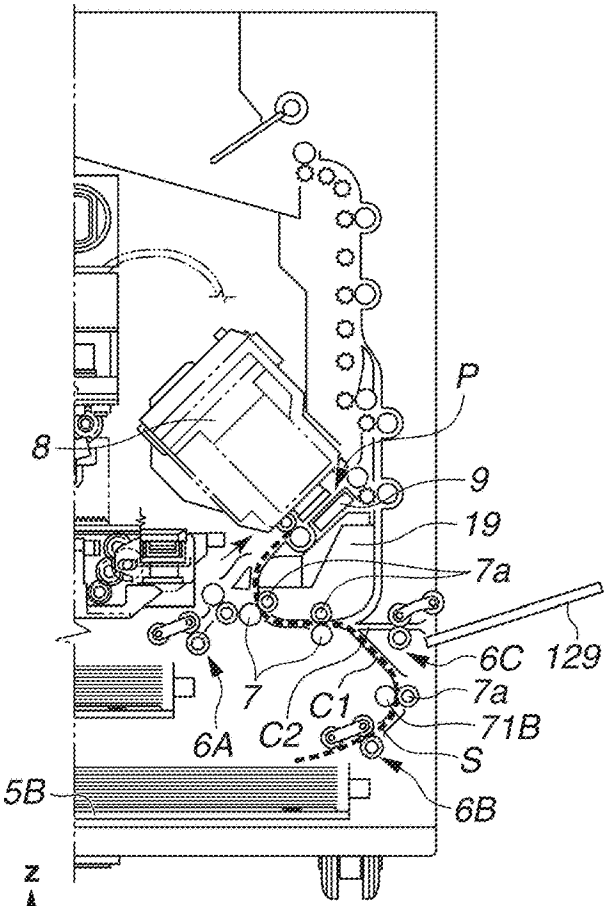

FIGS. 5A to 5C are diagrams illustrating a conveying path when recording media S of the A3 size stored in the second cassette 5B (the first supply source) are fed. A recording medium S stacked on the top in the second cassette 5B is separated from the second and subsequent recording media S by the second feeding unit 6B. Then, the recording medium S is conveyed toward the recording area P between the platen 9 and the recording head 8 while being nipped by conveying rollers 7 and pinch rollers 7*a*.

FIG. 5A illustrates a conveyance state immediately before the leading edge of the recording medium S reaches the recording area P. In a conveying path before the recording medium S fed by the second feeding unit 6B reaches the recording area P, a plurality of conveying rollers 7, pinch rollers 7*a*, and the inner guide 19 are disposed, whereby the recording medium S is conveyed to the platen 9 by being curved into an S-shape.

A conveying path after that is similar to that in the case of the recording medium S of the A4 size illustrated in FIGS. 4B and 4C. FIG. 5B illustrates a state where the leading edge of the recording medium S passes through the recording area P and the recording medium S is conveyed vertically upward. FIG. 5C illustrates a state where the leading edge of the recording medium S passes through the discharge roller 12 and the recording medium S is discharged to the discharge tray 13.

FIGS. 6A to 6D illustrate a conveying path in a case where the recording operation (two-sided recording) is performed on the back surface (the second surface) of the recording medium S of the A4 size. In a case where two-sided recording is performed, the recording operation is performed on the second surface (the back surface) after recording is performed on the first surface (the front surface). A conveyance process when recording is performed on the first surface is similar to that in FIGS. 4A to 4C, and therefore is omitted. A conveyance process after the state illustrated in FIG. 4C will be described below.

Figures 6A, 6B, 6C, 6D:
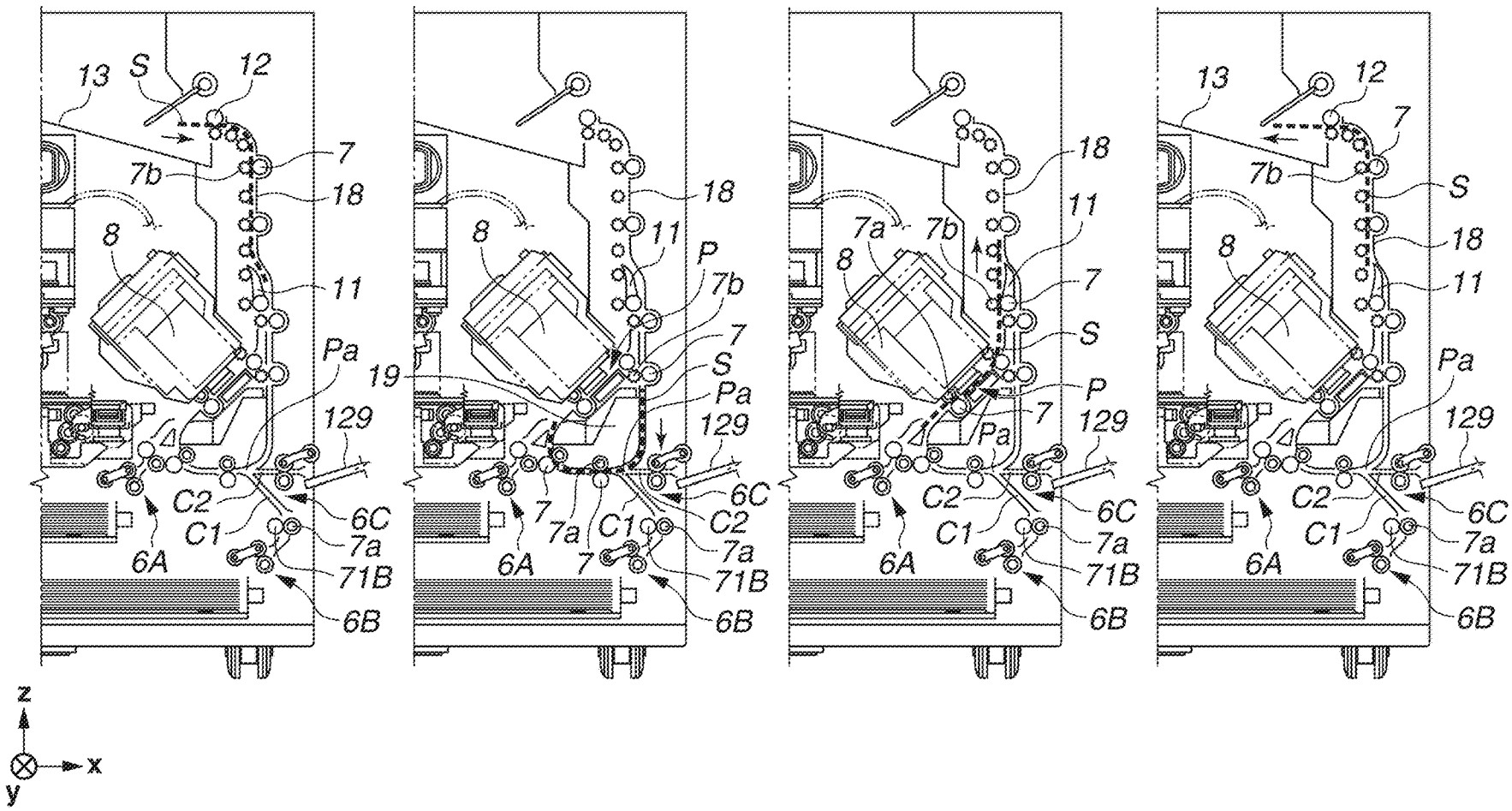
FIGS. 6A to 6D are diagrams illustrating a conveying path in a case where a recording operation is performed on a back surface of the recording medium.

If the recording operation on the first surface by the recording head 8 is completed and the trailing edge of the recording medium S passes through the flapper 11, the print controller 202 rotates the conveying rollers 7 backward and conveys the recording medium S into the recording apparatus 1. At this time, the flapper 11 is controlled by an actuator (not illustrated) so that the end of the flapper 11 is inclined to the left side. Thus, the leading edge of the recording medium S (the trailing edge of the first surface in the recording operation) passes through the right side of the flapper 11, and the recording medium S is conveyed vertically downward. FIG. 6A illustrates a state where the leading edge of the recording medium S (the trailing edge of the first surface in the recording operation) passes through the right side of the flapper 11.

Then, the recording medium S is conveyed along a curved outer surface of the inner guide 19 and conveyed to the recording area P between the recording head 8 and the platen 9 again. At this time, the second surface of the recording medium S is opposed to the discharge port surface 8*a* of the recording head 8. FIG. 6B illustrates a conveyance state immediately before the leading edge of the recording medium S reaches the recording area P for the recording operation on the second surface.

A conveying path after that is similar to that in the case where recording is performed on the first surface as illustrated in FIGS. 4B and 4C. FIG. 6C illustrates a state where the leading edge of the recording medium S passes through the recording area P and the recording medium S is conveyed vertically upward. At this time, the flapper 11 is controlled by the actuator (not illustrated) to move to the position where the end of the flapper 11 is inclined to the right side. FIG. 6D illustrates a state where the leading edge of the recording medium S passes through the discharge roller 12 and the recording medium S is discharged to the discharge tray 13.

As illustrated in FIGS. 6A to 6D, in the recording apparatus 1 according to the exemplary embodiments, a conveying path C2 connected to the manual feeding unit 6C (the second feeding portion) that feeds the recording medium S placed in the manual feed tray 129 is provided in addition to the above conveying paths. The manual feeding unit 6C feeds a relatively small number of recording media S placed in the manual feed tray 129 (the second supply source) that protrudes from one side portion (a right side portion in FIGS. 6A to 6D) of the recording apparatus 1, to a conveying path within the recording apparatus 1. At a joining position Pa, the conveying path C2 of the recording medium S fed by the manual feeding unit 6C joins an S-shaped conveying path C1 used to feed the recording medium S stored in the second cassette 5B. The feeding unit 6C feeds the recording medium S to conveying rollers 7 located downstream of the joining position Pa. Then, the recording medium S is conveyed by the conveying rollers 7 and pinch rollers 7*a* and reaches the recording area P via the same conveying path as the conveying path C1 of the recording medium S fed from the second cassette 5B.

Next, the maintenance operation on the recording head 8 will be described. As described with reference to FIG. 1, the maintenance unit 16 according to the exemplary embodiments includes the cap unit 10 and the wiping unit 17. The maintenance unit 16 causes the cap unit 10 and the wiping unit 17 to operate at a predetermined timing, thereby performing the maintenance operation.

Figure 7:
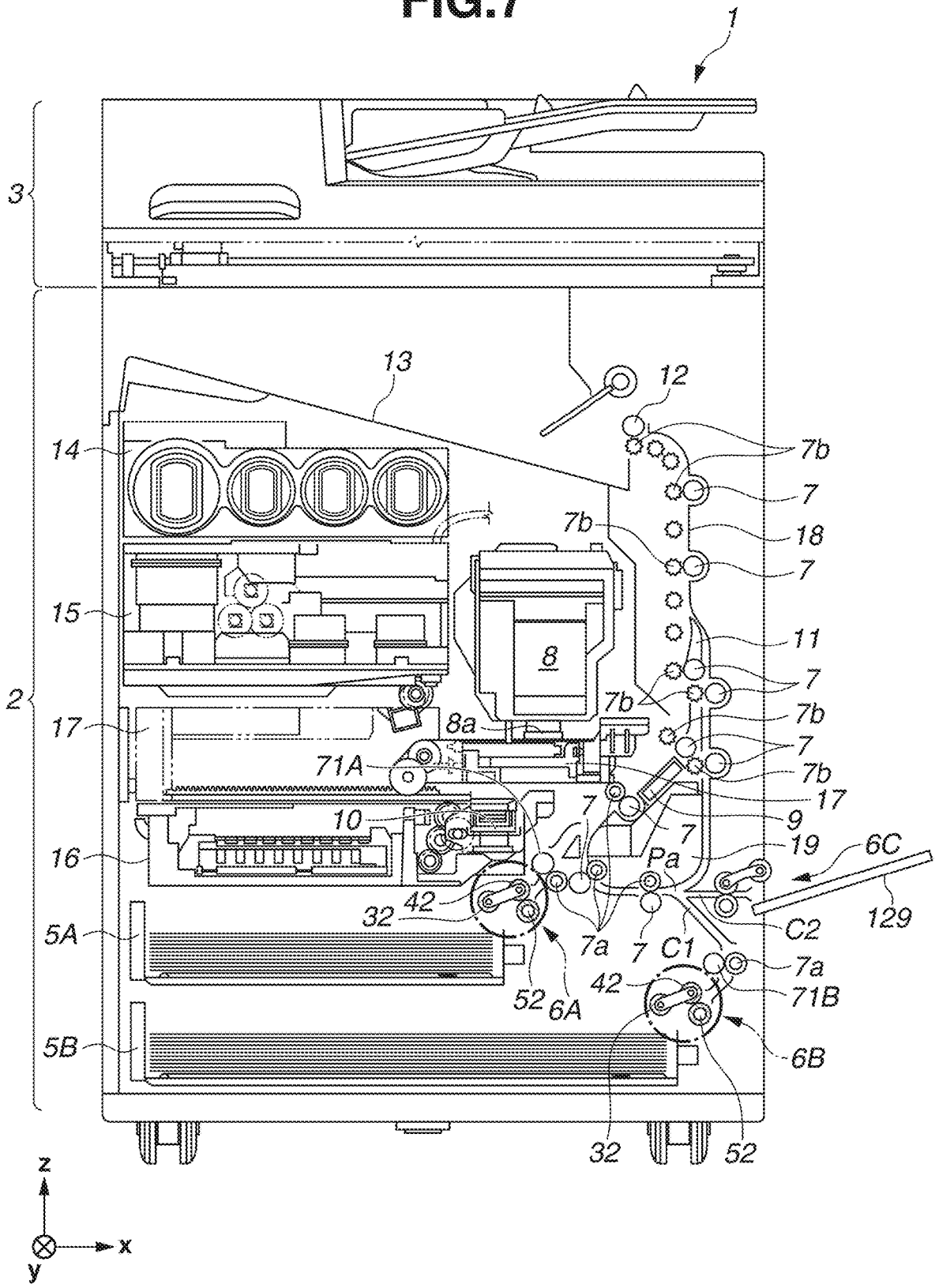
FIG. 7 is a diagram illustrating a maintenance state of the recording apparatus.

FIG. 7 is a diagram illustrating the maintenance state of the recording apparatus 1. When moving the recording head 8 from the standby position illustrated in FIG. 1 to a maintenance position illustrated in FIG. 7, the print controller 202 moves the recording head 8 vertically upward and also moves the cap unit 10 vertically downward. Then, the print controller 202 moves the wiping unit 17 from a retracted position in the right direction in FIG. 7. Then, the print controller 202 moves the recording head 8 vertically downward to the maintenance position where the maintenance unit 16 can perform the maintenance operation.

On the other hand, when moving the recording head 8 from the recording position illustrated in FIG. 3 to the maintenance position illustrated in FIG. 7, the print controller 202 moves the recording head 8 vertically upward while rotating the recording head 8 by 45 degrees. Then, the print controller 202 moves the wiping unit 17 from the retracted position toward the right direction. Then, the print controller 202 moves the recording head 8 vertically downward to the maintenance position where the maintenance unit 16 can perform the maintenance operation.

Figure 8:
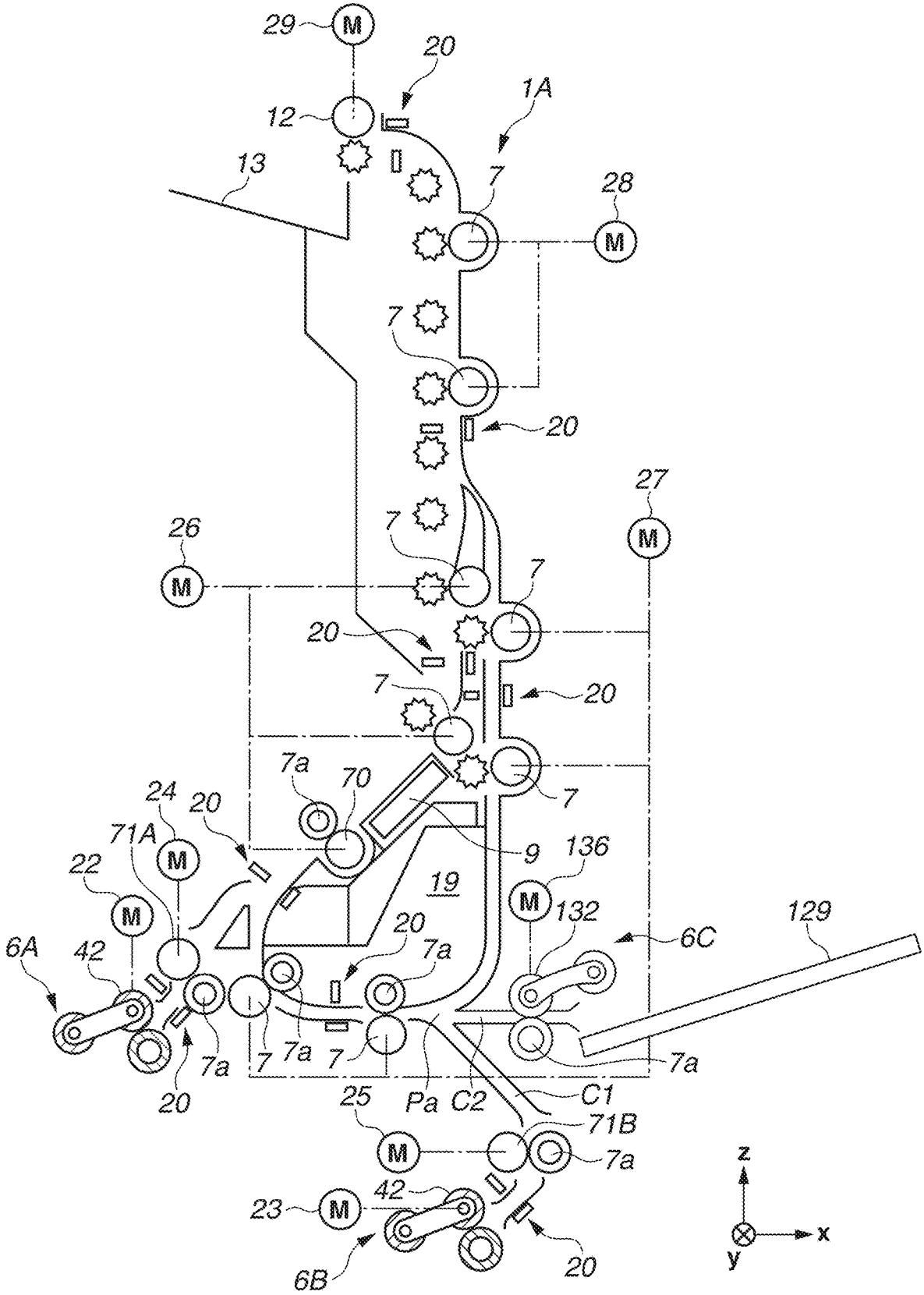
FIG. 8 is a diagram illustrating correspondence relationships between conveying rollers and motors.

FIG. 8 is a diagram illustrating the correspondence relationships between the plurality of motors and the driving rollers in the recording apparatus 1. A first feeding motor 22 rotates a second feeding roller 42 provided in the first feeding unit 6A for feeding the recording medium S from the first cassette 5A. A second feeding motor 23 rotates a second feeding roller 42 provided in the second feeding unit 6B for feeding the recording medium S from the second cassette 5B. A third feeding motor 136 drives a second manual feed roller 132 provided in the manual feeding unit 6C for feeding the recording medium S from the manual feed tray 129.

A first conveying motor 24 drives the first intermediate roller 71A that first conveys the recording medium S fed by the first feeding unit 6A. A second conveying motor 25 drives the second intermediate roller 71B that first conveys the recording medium S fed by the second feeding unit 6B.

A main conveying motor 26 drives a main conveying roller 70 that is disposed upstream of the platen 9 and mainly conveys the recording medium S on which recording is being performed. The main conveying motor 26 drives two conveying rollers 7 that are disposed downstream of the platen 9 and convey the recording medium S conveyed by the main conveying roller 70 further downstream.

A third conveying motor 27 drives two conveying rollers 7 that convey downward the recording medium S on the first surface of which recording has been performed. The third conveying motor 27 also drives two conveying rollers 7 disposed along the inner guide 19. The two conveying rollers 7 convey toward the recording head 8 the recording medium S fed from the second cassette 5B and conveyed by the second intermediate roller 71B, or the recording medium S on the first surface of which recording has been performed and the front and back surfaces of which have been reversed.

A fourth conveying motor 28 drives two conveying rollers 7 that convey upward or downward the recording medium S after the recording operation is performed. A discharge motor 29 drives the discharge roller 12 that discharges to the discharge tray 13 the recording medium S on which recording has been performed. As described above, each of the three feeding motors 22, 23, and 136, the five conveying motors 24 to 28, and the discharge motor 29 is associated with one or more driving rollers.

On the other hand, at eight points along the conveying paths, detection members 20 are disposed that detect the presence or absence of the recording medium S. Each of the detection members 20 includes a sensor and a mirror placed across the conveying path. The sensor including a light-emitting unit and a light-receiving unit is placed on one side of the conveying path, and the mirror is placed at a position on the other side of the conveying path and opposed to the sensor. Based on whether light emitted from the light-emitting unit of the sensor is reflected by the mirror and detected by the light-receiving unit, the presence or absence, i.e., the passing of the leading edge or the trailing edge, of the recording medium S is determined.

Based on the detection result of each of the plurality of detection members 20 and the output value of each of the encoders 21 that detect the amounts of rotation of the driving rollers, the conveyance control unit 207 individually drives the first feeding motor 22, the second feeding motor 23, the third feeding motor 136, the conveying motors 24 to 28, and the discharge motor 29. This controls the conveyance of the entire apparatus.

A first exemplary embodiment will be described. As illustrated in FIGS. 4A to 4C and 5A to 5C, the recording medium S is conveyed from the first cassette 5A or the second cassette 5B to the recording area P. When the recording medium S is conveyed, an operation such as sliding friction between the recording medium S and a component forming the conveying path or separation between the recording medium S and the driving rollers is performed. At this time, the operation such as the sliding friction or the peeling charges the recording medium S with positive or negative charges.

If the charged recording medium S is conveyed to the recording area P, Coulomb force is generated by the potential difference between the recording medium S and the recording head 8. By the Coulomb force, dust on the surface of the recording medium S may attach to the discharge port surface 8*a* of the recording head 8. If the discharge ports formed in the discharge port surface 8*a* of the recording head 8 are blocked by the dust, the recording head 8 may enter a non-discharge state where ink droplets are not discharged. This may inhibit image formation.

Figure 9:
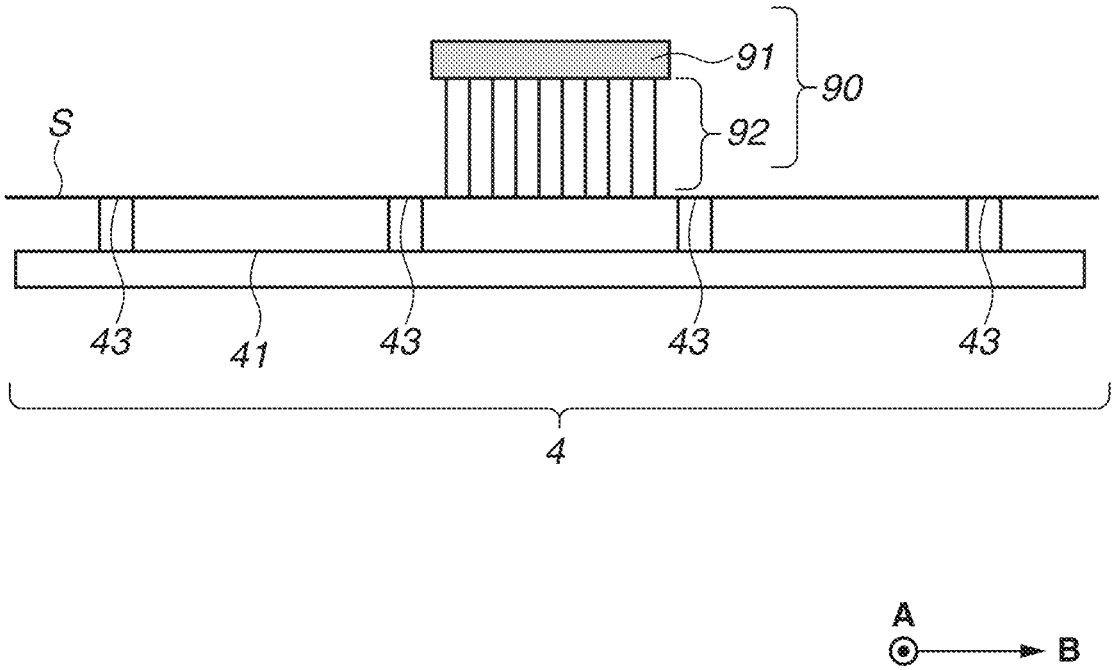
FIG. 9 is a diagram illustrating placement of abutment surfaces and a static elimination portion.

FIG. 9 is a schematic diagram illustrating the placement of a supporting member 4 and a static elimination unit 90 according to the first exemplary embodiment of the present disclosure. To prevent dust from attaching to the discharge port surface 8*a* of the recording head 8 as described above, the static elimination unit 90 as a static elimination unit eliminates static from the recording medium S. The static elimination unit 90 is placed in either or both of the conveying path from the first feeding unit 6A to the recording area P or the conveying path from the second feeding unit 6B to the recording area P illustrated in FIG. 1.

In FIG. 9, the recording medium S is conveyed in a conveying direction A. When the recording medium S is conveyed from the first feeding unit 6A or the second feeding unit 6B to the recording area P, the back surface of the recording medium S is supported by the supporting member 4 as a supporting unit. The supporting member 4 is provided in such a shape that the supporting member 4 extends in the conveying direction A on the conveying path of the recording medium S as illustrated in FIG. 4A to 4C, 5A to 5C, or 6A to 6D, and supports the recording medium S. The surface of the supporting member 4 has an uneven shape. The supporting member 4 includes a non-abutment surface 41 that does not come into contact with the recording medium S, and a plurality of abutment surfaces 43 that is provided in a width direction B of the recording medium S and comes into contact with the recording medium S. To reduce sliding contact resistance between the abutment surfaces 43 and the recording medium S, it is desirable to configure the width (length) in the width direction B of each abutment surface 43 to be approximately 1 mm. The abutment surface 43 has a structure where the abutment surface 43 has a depth in the conveying direction A. The non-abutment surface 41 is the collective term of a portion where the supporting member 4 and the recording medium S do not come into contact with each other on the surface of the supporting member 4 having the unevenness shape.

The static elimination unit 90 includes a conductive portion 91 as a conductive member and a static elimination portion 92. The conductive portion 91 is connected to a recording medium conveying unit or an earth portion (not illustrated) in the recording apparatus 1 and is electrically continuous. For example, the static elimination portion 92 includes a hair bundle-like brush composed of conductive stainless steel fibers.

The static elimination unit 90 is placed at a position opposed to the non-abutment surface 41 of the supporting member 4 and a position not opposed to the abutment surfaces 43. When the back surface of the recording medium S abuts the abutment surfaces 43 of the supporting member 4, the static elimination unit 90 is opposed to the front surface of the recording medium S. It is desirable to configure the static elimination portion 92 to, when the back surface of the recording medium S is supported by the supporting member 4, come into contact with the front surface of the recording medium S or separate from the front surface of the recording medium S by a separation amount of 1 mm or less.

Figure 10A:
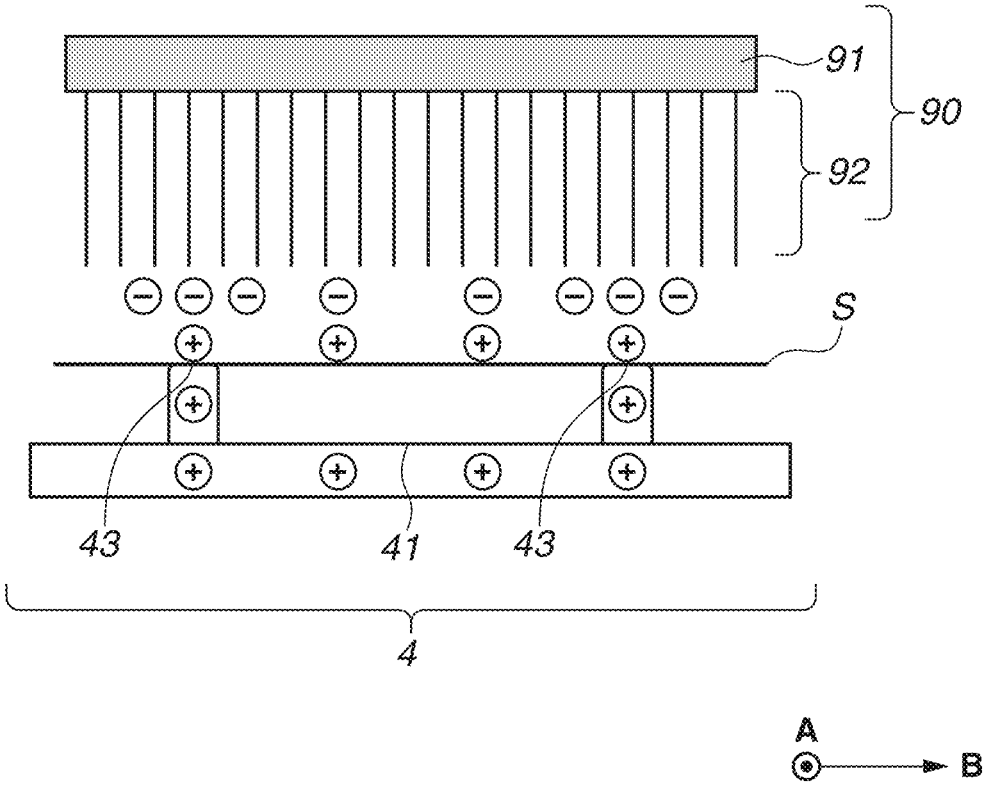
FIGS. 10A and 10B are diagrams illustrating a static elimination mechanism for eliminating static from the recording medium in a comparative example.
Figure 10B:
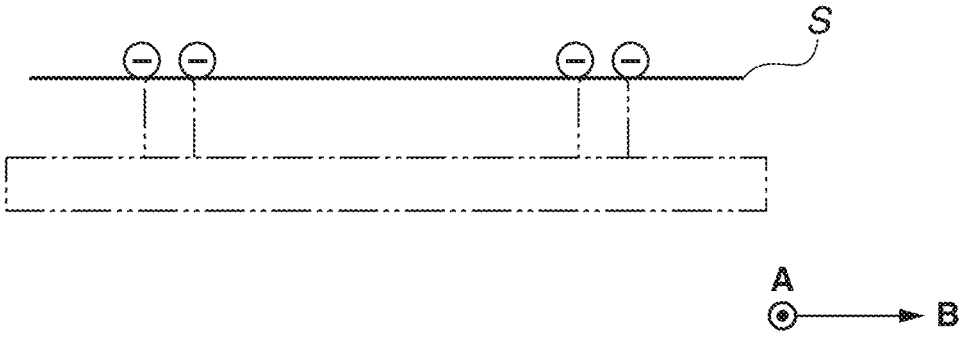

FIG. 10A is a schematic diagram illustrating a static elimination mechanism in a case where the static elimination unit 90 is installed at a position opposed to the abutment surfaces 43 of the supporting member 4 as a comparative example. FIG. 10B is a schematic diagram illustrating the amount of charge of the recording medium S after the recording medium S passes through the static elimination unit 90 in the configuration of FIG. 10A.

Every time the recording apparatus 1 performs the recording operation, the supporting member 4 comes into contact with the recording medium S. By this contact, charges are accumulated in the supporting member 4, and therefore, the amount of charge of the supporting member 4 is greater than the amount of charge of the recording medium S. In a case where the static elimination unit 90 is also placed at a position opposed to the abutment surfaces 43 of the supporting member 4, the static elimination unit 90 eliminates static corresponding to the combined amount of charge of the amounts of charge of the abutment surfaces 43 and the amount of charge of the recording medium S.

At this time, the static elimination unit 90 excessively eliminates static corresponding to the amounts of charge of the abutment surfaces 43 with respect to the amount of charge of the recording medium S alone. At this time, charges corresponding to the excessively eliminated static remain on the surface of the recording medium S as illustrated in FIG. 10B. As described above, since the amount of charge of the supporting member 4 is relatively greater than the amount of charge of the recording medium S, there is a case where more charges remain on the recording medium S after the static elimination unit 90 eliminates static than before the recording medium S passes through the static elimination unit 90. That is, the amount of charge of the recording medium S after passing through the static elimination unit 90 may increase compared to the amount of charge of the recording medium S before passing through the static elimination unit 90.

Figure 11A:
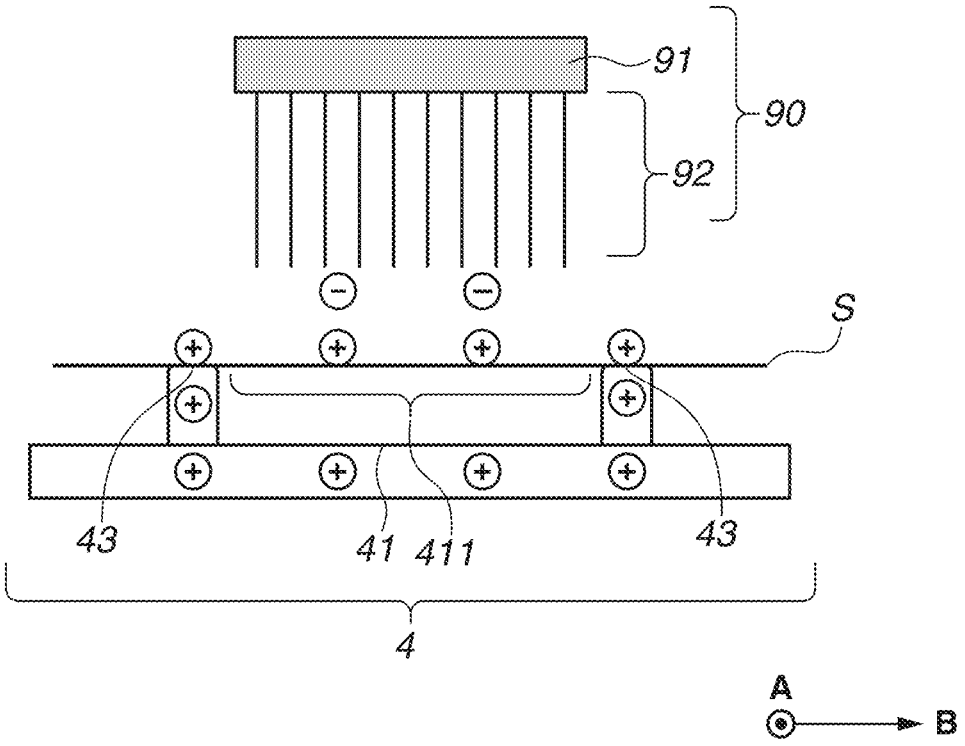
FIGS. 11A and 11B are diagrams illustrating a static elimination mechanism for eliminating static from the recording medium in a case where a static elimination portion is placed at a position opposed to abutment surfaces.

FIG. 11A is a schematic diagram illustrating a mechanism in which the static elimination unit 90 eliminates static from the recording medium S according to the present exemplary embodiment. The static elimination unit 90 is placed at a position opposed to the non-abutment surface 41 of the supporting member 4 and a position not opposed to the abutment surfaces 43. At this time, an area 411 where the static elimination unit 90 eliminates static from the recording medium S does not include portions facing the abutment surfaces 43. Thus, in the area 411 where the recording medium S is opposed to the non-abutment surface 41, the static elimination unit 90 eliminates static according to the amount of charge with which the recording medium S is charged.

Figure 11B:
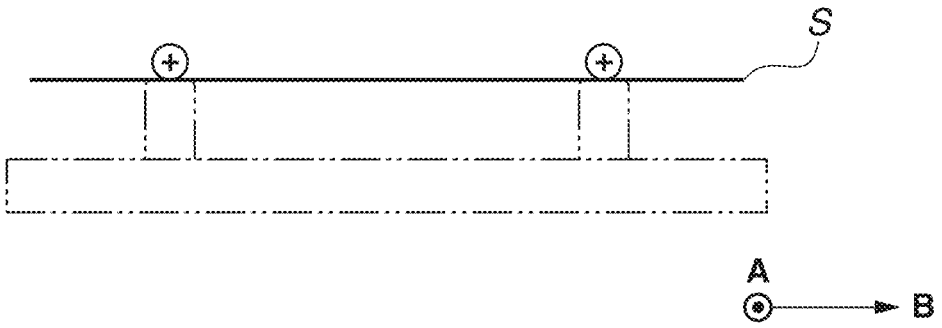

FIG. 11B is a schematic diagram illustrating the amount of charge of the recording medium S after the recording medium S passes through the static elimination unit 90 according to the present exemplary embodiment. The static elimination unit 90 is placed as illustrated in FIG. 11A, whereby the static elimination unit 90 can eliminate static according to only the amount of charge of the recording medium S in the area 411. This can eliminate static from the recording medium S more efficiently than in the placement state of the static elimination unit 90 in FIGS. 10A and 10B.

As a result, static is eliminated more appropriately from the recording medium S after passing through the static elimination unit 90 than in the case of FIG. 10B. Thus, even if the recording medium S is conveyed to the recording area P, there is little potential difference between the recording medium S and the recording head 8, and therefore, little Coulomb force is generated.

Thus, it is possible to prevent dust on the surface of the recording medium S from attaching to the discharge port surface 8*a* of the recording head 8. Moreover, the frequency of the maintenance operation for removing dust attached to the discharge port surface 8*a* of the recording head 8 also decreases, and therefore, it is possible to provide a highly productive recording apparatus.

As described above, the static elimination portion 92 is placed at a position not opposed to the abutment surfaces 43 that come into contact with the recording medium S, whereby the static elimination unit 90 can efficiently eliminate static from the recording medium S.

A second exemplary embodiment will be described below. Components similar to those in the first exemplary embodiment will not be described.

Figure 12:
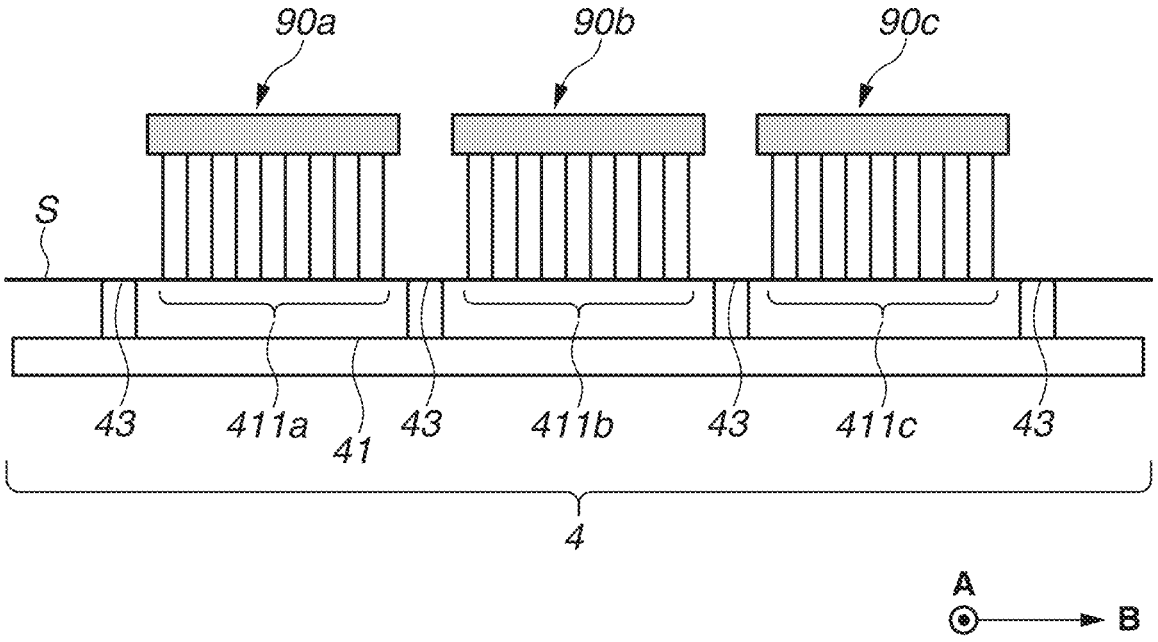
FIG. 12 is a diagram illustrating placement of abutment surfaces and static elimination portions according to a second exemplary embodiment.

In the second exemplary embodiment, a plurality of static elimination units 90 is placed. FIG. 12 is a schematic diagram illustrating the placement of static elimination units 90*a*, 90*b*, and 90*c* and abutment surfaces 43. There is a case where the recording medium S is charged over its entire area in the width direction B. In response, in the present exemplary embodiment, the static elimination units 90*a*, 90*b*, and 90*c* are placed next to each other in the width direction B. At this time, each of the static elimination units 90*a*, 90*b*, and 90*c* is placed at a position opposed to a non-abutment surface 41 of a supporting member 4 and a position not opposed to the abutment surfaces 43.

Since the static elimination units 90 are not placed at positions opposed to the abutment surfaces 43, the static elimination units 90*a*, 90*b*, and 90*c* eliminate static according to the amounts of charge of areas 411*a*, 411*b*, and 411*c* of the recording medium S to which the static elimination units 90*a*, 90*b*, and 90*c* are opposed. Although the static elimination units 90*a*, 90*b*, and 90*c* have the same widths in the width direction B in FIG. 12, there is also a case where the spaces (distances) between adjacent abutment surfaces 43 are different from each other. Thus, the static elimination units 90*a*, 90*b*, and 90*c* having different widths may be placed in the width direction B according to the spaces between the abutment surfaces 43. The number of placed static elimination units 90 is not limited to three, and two static elimination units 90 or four or more static elimination units 90 may be provided.

Figure 13:
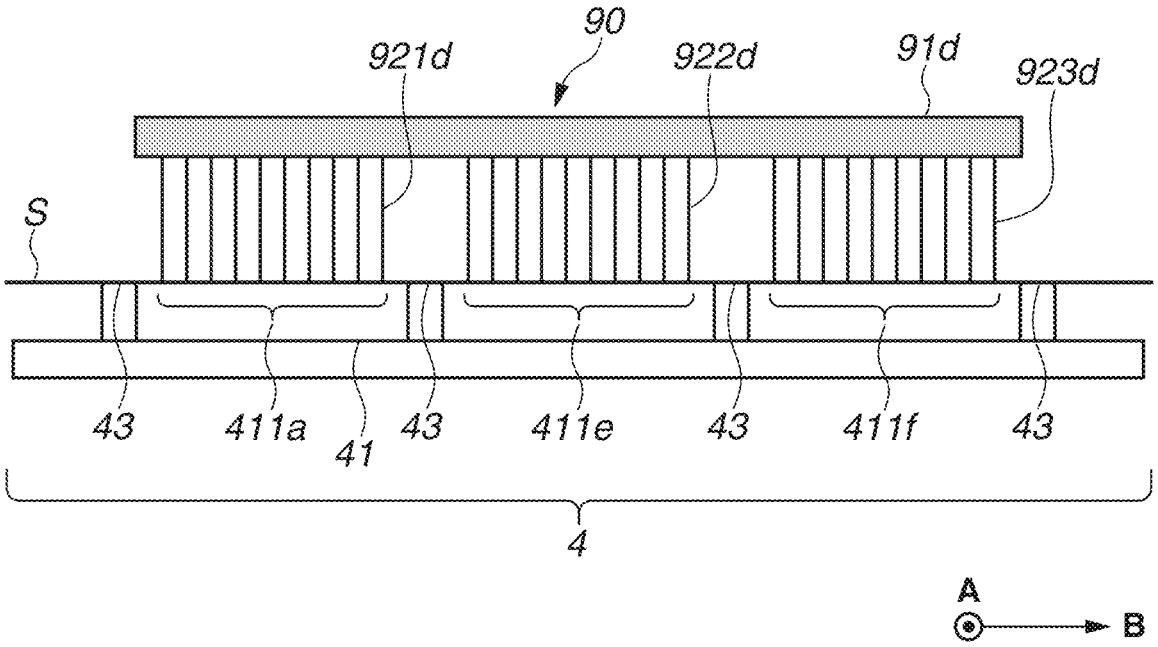
FIG. 13 is a diagram illustrating placement of abutment surfaces and a static elimination portion according to a third exemplary embodiment.
Figure 14:
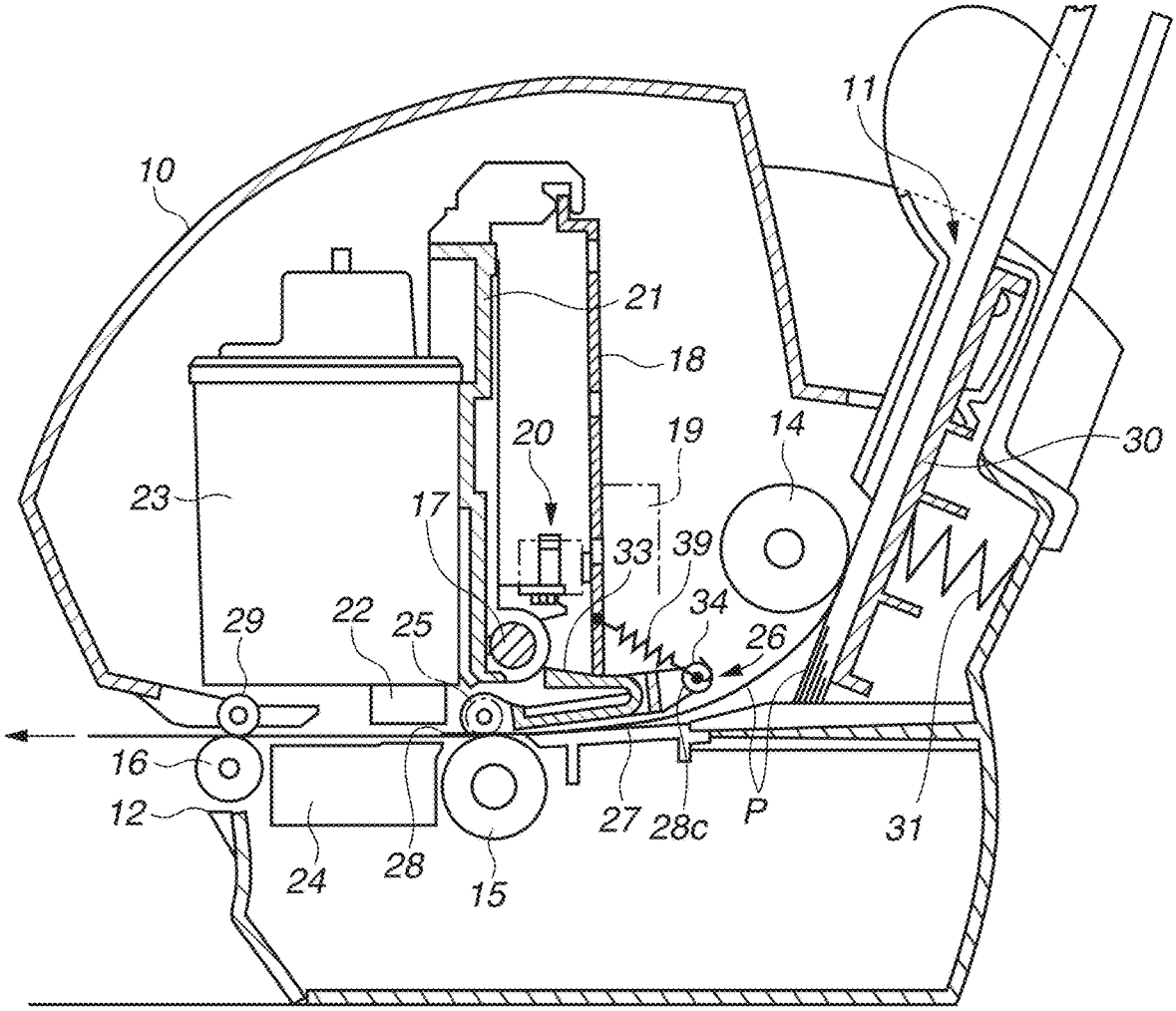
FIG. 14 is a cross-sectional view illustrating a feeding device in a conventional recording apparatus.

A third exemplary embodiment will be described below. Components similar to those in the first and second exemplary embodiments will not be described. FIG. 13 is a schematic diagram illustrating the placement of a static elimination unit 90 and a supporting member 4 in a case where a single static elimination unit 90 is placed over the entire area of the recording medium S. The static elimination unit 90 is configured so that a plurality of static elimination portions 921*d*, 922*d*, and 923*d* is provided next to each other in the width direction B for a common conductive portion 91*d*. Each of the static elimination portions 921*d*, 922*d*, and 923*d* is placed at a position opposed to a non-abutment surface 41 of the supporting member 4 and a position not opposed to abutment surfaces 43.

At this time, the static elimination portions 921*d*, 922*d*, and 923*d* eliminate static according to the amounts of charge of areas 411*d*, 411*e*, and 411*f* of the recording medium S to which the static elimination portions 921*d*, 922*d*, and 923*d* are opposed. Thus, the static elimination unit 90 can efficiently eliminate static from the recording medium S without being influenced by the amounts of charge of the abutment surfaces 43.

A plurality of static elimination units 90 in each of which a plurality of static elimination portions is provided for a single conductive portion as described above may be provided in the width direction B of the recording medium S. In this case, each of the static elimination portions placed in the plurality of static elimination units 90 provided in the width direction B can efficiently eliminate static from the recording medium S.

In each of the exemplary embodiments, a biasing unit that biases the recording medium S toward the supporting member 4 may be provided. For example, the biasing unit is a conveying roller pair of a conveying roller 7 and a pinch roller 7*a* as illustrated in FIG. 1. The biasing unit is placed upstream of the supporting member 4 in the conveying direction of the recording medium S, whereby it is possible to cause the recording medium S to securely abut the abutment surfaces 43. Consequently, it is possible to always set the same distance between the recording medium S and the static elimination portion 92 of the static elimination unit 90.

In a case where the biasing unit is provided as described above, the recording medium S is charged by sliding friction between the biasing unit and the recording medium S. Thus, it is desirable to place the static elimination unit 90 downstream of the biasing unit in the conveying direction of the recording medium S. The biasing unit is not provided downstream of the static elimination unit 90 in the conveying direction of the recording medium S, whereby the recording medium S is conveyed to the recording area P while maintaining the state where static is eliminated from the recording medium S.

The present disclosure is also applicable to a recording apparatus using a recording method other than the inkjet recording method. The present disclosure is applicable to the feeding and the conveyance of a recording medium in various recording apparatuses such as a recording apparatus that performs recording using an electrophotographic method, and a thermal transfer recording apparatus.

According to the present disclosure, it is possible to provide a recording apparatus that efficiently eliminates static from a recording medium.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-093997, filed Jun. 4, 2021, which is hereby incorporated by reference herein in its entirety.

What is claimed is:

1. A recording apparatus comprising:

a conveying unit configured to convey a recording medium in a first direction to a recording area where recording is performed by a recording unit;

a supporting unit configured to support the recording medium conveyed by the conveying unit, wherein the supporting unit includes an abutment surface configured to abut the recording medium when the supporting unit supports the recording medium; and a static elimination unit configured to eliminate static from the recording medium in a static elimination portion, wherein the static elimination portion is not provided at a position opposed to the abutment surface and is provided at a position not opposed to the abutment surface in the supporting unit.

2. The recording apparatus according to claim 1, wherein the supporting unit includes a non-abutment surface configured not to abut the recording medium when the supporting unit supports the recording medium.

3. The recording apparatus according to claim 2, wherein the static elimination portion is provided at a position opposed to the non-abutment surface.

4. The recording apparatus according to claim 1, wherein the static elimination portion has a hair bundle-like shape.

5. The recording apparatus according to claim 1, wherein the supporting unit includes a plurality of the abutment surfaces.

6. The recording apparatus according to claim 1, wherein a plurality of the static elimination units is provided in the first direction.

7. The recording apparatus according to claim 1, wherein the static elimination unit includes a conductive member.

8. The recording apparatus according to claim 7, wherein a plurality of the static elimination portions is provided in the conductive member.

9. The recording apparatus according to claim 1, wherein the static elimination unit is provided at a position upstream of the recording area in the first direction.

10. The recording apparatus according to claim 1, further comprising a feeding unit configured to feed the recording medium to the conveying unit.

11. The recording apparatus according to claim 10, wherein the static elimination unit is provided at a position downstream of the feeding unit in the first direction.

12. The recording apparatus according to claim 1, wherein the recording unit moves to a recording position when the recording unit performs recording on the recording medium.

13. A conveying apparatus comprising:

a conveying unit configured to convey a medium in a first direction;

a supporting unit configured to support the medium conveyed by the conveying unit, wherein the supporting unit includes an abutment surface configured to abut the medium when the supporting unit supports the medium; and a static elimination unit configured to eliminate static from the medium in a static elimination portion, wherein the static elimination portion is not provided at a position opposed to the abutment surface and is provided at a position not opposed to the abutment surface in the supporting unit.

14. The conveying apparatus according to claim 13, wherein the supporting unit includes a non-abutment surface configured not to abut the medium when the supporting unit supports the medium.

15. The conveying apparatus according to claim 14, wherein the static elimination portion is provided at a position opposed to the non-abutment surface.

16. The conveying apparatus according to claim 13, wherein the static elimination portion has a hair bundle-like shape.

17. The conveying apparatus according to claim 13, wherein the supporting unit includes a plurality of the abutment surfaces.

18. The conveying apparatus according to claim 13, wherein a plurality of the static elimination units is provided in the first direction.

19. The conveying apparatus according to claim 13, wherein the static elimination unit includes a conductive portion.

20. The conveying apparatus according to claim 19, wherein a plurality of the static elimination portions is provided in the conductive portion.

* * * * *